US005980339A

United States Patent [19]

Hartman et al.

[11] Patent Number: 5,980,339

[45] Date of Patent: Nov. 9, 1999

[54] HYDRAULIC TRIM CYLINDER FOR MARINE STERN DRIVES AND OUTBOARD MOTORS

[75] Inventors: John E. Hartman, Painesville; Paul M. Dadd, Mentor; John T. Venaleck, Painesville, all of Ohio

[73] Assignee: Ohio Associated Enterprises, Inc., Painesville, Ohio

[21] Appl. No.: 08/968,080

[22] Filed: Nov. 12, 1997

Related U.S. Application Data

[60] Provisional application No. 60/029,703, Nov. 12, 1996.

[51] Int. Cl.[6] ..... B63H 5/125

[52] U.S. Cl. ..... 440/61; 440/65

[58] Field of Search ..... 440/65, 61, 66

[56] References Cited

U.S. PATENT DOCUMENTS 5,389,018 2/1995 Funami ..... 440/61

5,489,226 2/1996 Nakamura et al. ..... 440/61

*Primary Examiner*—Stephen Avila

*Attorney, Agent, or Firm*—Renner, Otto, Boisselle & Sklar, P.L.L.

[57] ABSTRACT

It is an object of the current invention to provide a trim cylinder that is cost effective; it is further an object of the invention to provide a cylinder that has few parts, less than one-third the number of parts of present art; it is further an object of the invention to provide a unique and simple check valve for operation as a shock absorber and further to provide passages integral of the extruded or molded body allowing plumbing to be attached at one end only of the cylinder; also to eliminate the plastic shroud which normally covers unsightly plumbing.

39 Claims, 4 Drawing Sheets

HYDRAULIC TRIM CYLINDER FOR MARINE STERN DRIVES AND OUTBOARD MOTORS

This application claims the benefit of U.S. Provisional Application No. 60/029,703 filed Nov. 12, 1996.

BACKGROUND OF THE INVENTION

The subject invention involves a unique hydraulic cylinder design usable in the Marine Industry for trim cylinders on stern drives and outboard motors. Present practice involves cylinders that are expensive to produce because they have many parts and require close tolerance machining operations.

SUMMARY OF THE INVENTION

It is an object of the current invention to provide a trim cylinder that is cost effective; it is a further object of the invention to provide a cylinder that has few parts—less than one-third the number of parts of present art; it is a further object of the invention to provide a unique and simple check valve for operation as a shock absorber and further to provide passages integral of the extruded or molded body allowing plumbing to be attached at one end only of the cylinder; also to eliminate the plastic shroud which normally covers unsightly plumbing.

This cylinder is designed for proof pressures eight times its normal maximum operating pressure to accommodate the occasion when the propeller drive housing accidentally hits a heavy object at speed in the water. The design incorporates a novel piston which allows pressure relief and provides energy absorption from flow resistance through restrictive ports. The design incorporates many cost effective features including:

1. Three-piece piston design; existing designs have 29-piece construction
2. Plastic molded and bonded end caps requiring no machining operations on the housing.
3. Broached extruded or molded plastic housing with integral fluid passages.

According to an aspect of the invention, an hydraulic actuator includes a housing having an annular bore and a piston slidable within the bore, the piston including a body with at least one fluid passage therethrough and a check valve for selectively allowing fluid flow through the at least one passage. The check valve may include an annular spring and a preload mechanism for urging the spring against the body; the spring may be a Belleville washer.

The housing may be a single plastic molded piece having the annular bore therein and an end portion which is substantially closed. The actuator may also include an end cap at the end of the annular bore opposite the end portion and/or a tapered plug inserted in a hole through the end portion. The body may have at least one resilient seal in contact with the bore portion, the at least one seal being able to accommodate variations in diameter of the bore portion or changes in diameter of the bore portion due to changes in pressure within the housing.

Alternatively, the housing may include a cylinder and two end caps adhesively adhered to the cylinder. The cylinder may be metal and the end caps plastic.

According to another aspect of the invention, a check valve mechanism includes a body having at least one fluid passage therethrough; an annular spring mechanism alternatively in a closed position preventing fluid flow through the body when the spring is in contact with the body, or in an open position allowing fluid flow through the body when the spring is not in contact with the body; and a preload mechanism for urging the spring against the body; wherein the spring is in the open position when a pressure difference across the spring is greater than a given value and the spring is in the closed position when the pressure difference is less than the given value.

According to still another aspect of the invention, an hydraulic trim cylinder includes a housing having an annular bore and a piston slidable within the bore, the piston including a body with at least one fluid passage therethrough and a check valve for selectively allowing fluid flow through the at least one passage. The check valve may include an annular spring and a preload mechanism for urging the spring against the body; the spring may be a Belleville washer.

The housing may be a single plastic molded piece having the annular bore therein and an end portion which is substantially closed. The trim cylinder may also include an end cap at the end of the annular bore opposite the end portion and/or a tapered plug inserted in a hole through the end portion. The body may have at least one resilient seal in contact with the bore portion, the at least one seal being able to accommodate variations in diameter of the bore portion or changes in diameter of the bore portion due to changes in pressure within the housing.

Alternatively, the housing may include a cylinder and two end caps adhesively adhered to the cylinder. The cylinder may be metal and the end caps plastic.

According to a further aspect of the present invention, a method of absorbing shocks in a hydraulic trim cylinder comprises preventing flow around a piston body by use of a seal around the perimeter of the body, and preventing flow through fluid passages in the body by use of an annular seal which seals by contact with a seal land on the body and a seal land on a preloading member connected to the body.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
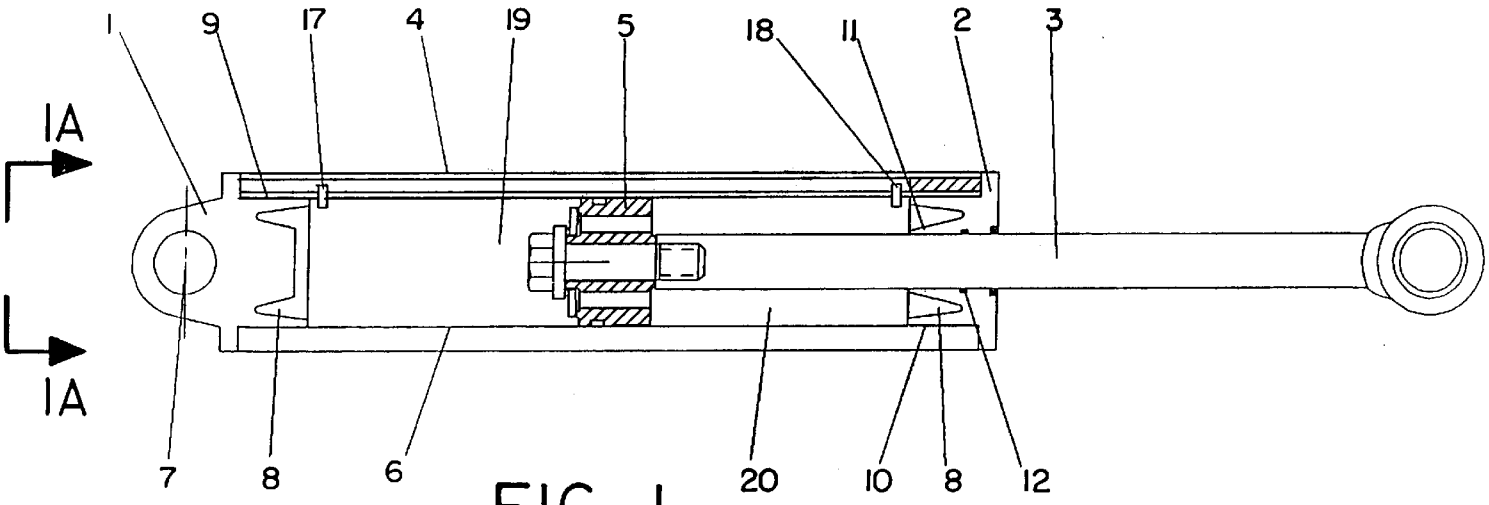
FIG. 1 is a side elevation partly in section showing a schematic illustration of the trim cylinder of the invention.

FIG. 1 shows a section of the invention through its longitudinal axis and generally describes the major working components.

The plastic end caps (1) and (2) are bonded to the housing (4). The three-piece piston (5) is bolted to the rod (3). The unique design of each of these elements will become apparent as they are described below.

Figure 6A:
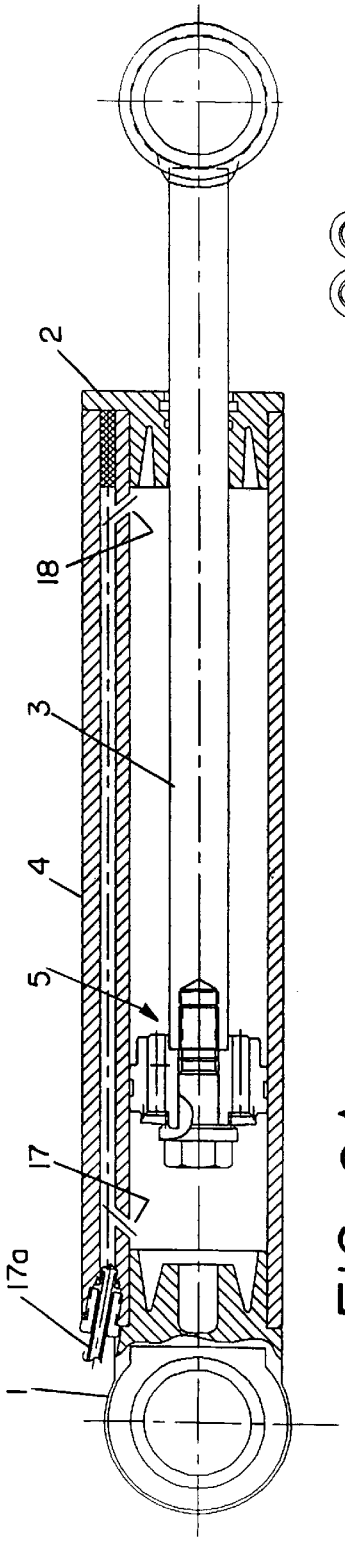
FIGS. 6A and 6B are section and right end elevation views of the trim cylinder similar to the illustration in FIG. 1.
Figure 6B:
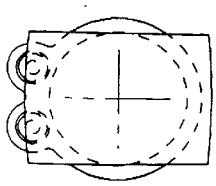
Figure 7:
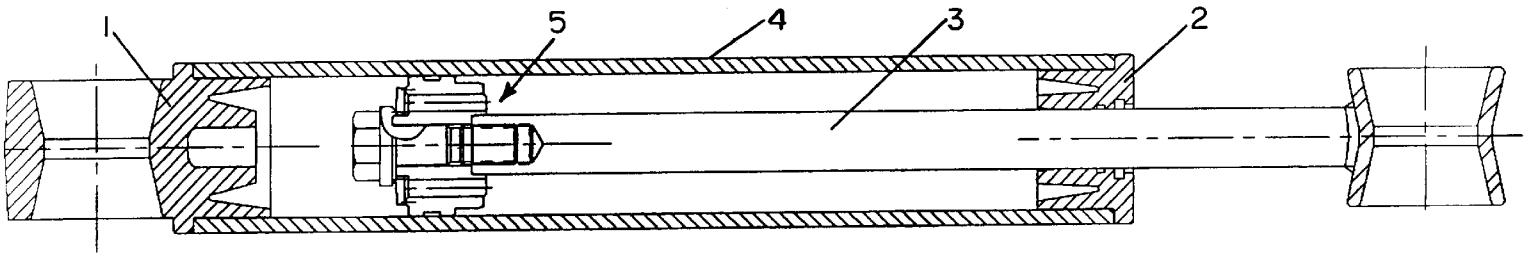
FIG. 7 is a section view similar to FIG. 6A with the trim cylinder rotated 90 degrees about its longitudinal axis.

The end cap (1) has two major functions; first to seal the bore (6) of the housing (4) against hydraulic fluid leakage; and, second, to provide attachment means (7) to the stationary portion of the main drive. Since the hydraulic proof pressures are very high, on the order of 8000 psi, the housing (4) will expand radially causing the bore (6) to grow larger. Provision in the design has been made for chamber (8), allowing the same pressure in the cylinder to effect expansion of the plastic of the end cap. Since the modulus and the overall stiffness of the plastic elements (1) and (2) are somewhat less than that of the housing (4), there will exist a compression in the adhesive joints (9) and (10). This compressive pressure will allow greater shear stress capability in the adhesive joint in accordance with Von-Mises' criteria and, therefore, not only protects the joint from tensile stresses but actually increases the joint's capability to withstand shear imposed by hydraulic pressures in the cylinder bore (6). Lip (11) and pressure in chamber (8) allows for compression of the plastic cap (2) against the rod (3) effecting a hydraulic seal at high-cylinder pressures. At normal pressures "O"-ring seal (12) prevents leakage. There are two longitudinal passages (13) and (14) attached at fitting threads (15) and (16) to the hydraulic pumps and valves. These passages communicate with the cylinder bore (6) on alternate sides of the piston (5) at ports (17) and (18). One of the longitudinal passages (13) and (14) is in communication with chamber (19) through port (17) and that the other of the longitudinal passages (13) and (14) is in communication with chamber (20) through port (18). The ports (17) and (18) are both shown in FIGS. 1 and 6A only to indicate their locations, and not to indicate the connection of a single longitudinal passage with both chambers (19) and (20).

In operation, pressurization of the hydraulic line leading to port (15) (lines not shown) allows pressurized fluid to enter chamber (19) through port (17) forcing the piston to the right in FIG. 1, extending the rod (3) and forcing the fluid from chamber (20) through port (18) back to the pump reservoir. Alternately, pressurizing of the hydraulic line leading to port (16) allows pressurized fluid to enter chamber (20) through port (18), forcing the piston to the left in the diagram of FIG. 1, retracting the rod (3) and forcing fluid from chamber (19) through port (17) back to the pump reservoir.

Figure 2:
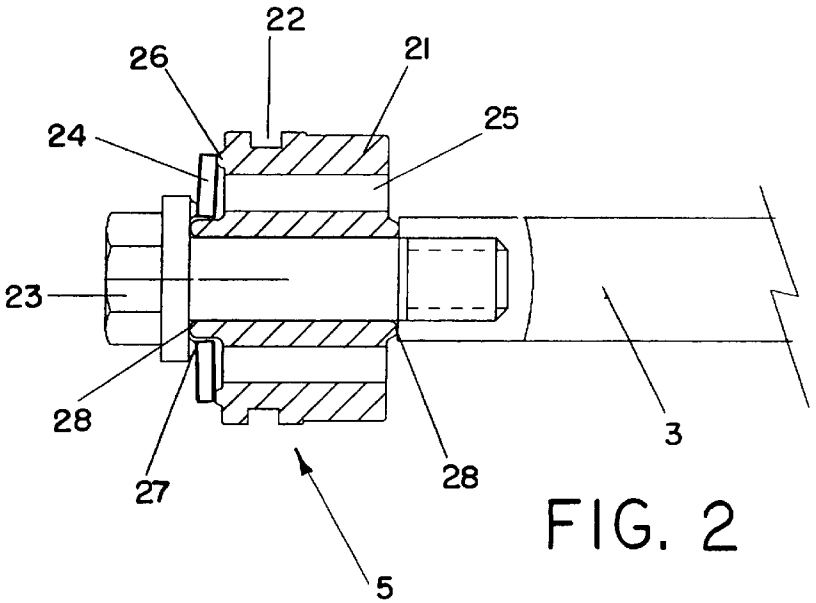
FIG. 2 is an enlarged view, partly in section of the piston assembly and rod.
Figure 1A:
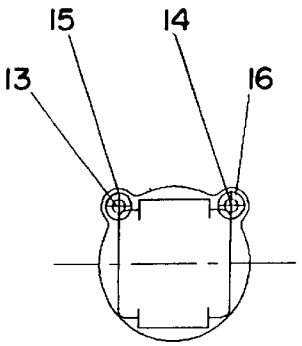
FIG. 1A is an end view of the trim cylinder of FIG. 1 looking in the direction of arrows 1A—1A of FIG. 1.

A shock-absorbing operation is now described. When an object in the water accidentally impacts the stem drive of a boat at speed, the rod (3) is forcibly extended causing pressure in chamber (20) to rise rapidly. Referring to FIG. 2, the three-piece piston (5) consists of a retainer bolt (23), a body (21) and a Belleville washer seal (24). Seal (22) prevents flow across the piston (5) at the surface of the bore (6) and washer (24) prevents flow through the piston at ports (25) by sealing at seal lands (26) and (27).

Figure 5:
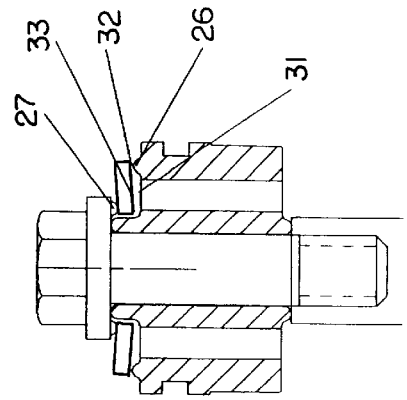
FIG. 5 is a section view of the piston assembly with the Belleville washer in fluid passing mode.
Figure 4:
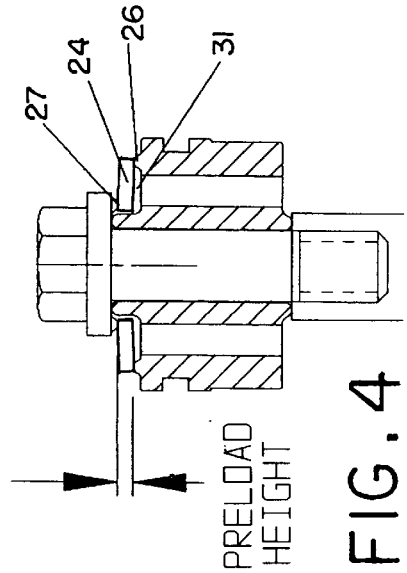
FIG. 4 is a section view of the piston assembly with the Belleville washer in sealing mode.
Figure 3:
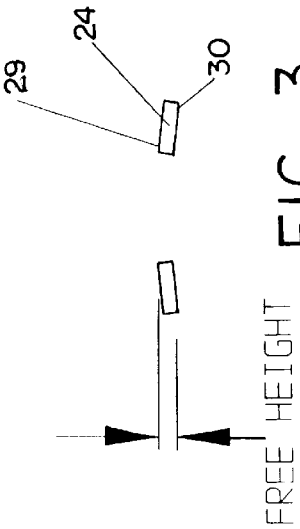
FIG. 3 is a section view of a Belleville washer used in the trim cylinder.

Referring to FIGS. 3–5, the Belleville washer (24) is a spring member designed by conventional techniques but prepared in the following special way. Surfaces (29) and (30) are smooth and parallel and will be the surfaces that will seal at lands (26) and (27). The entire washer is conformal coated with a soft substance such as tin, lead, cadmium, or the like. The entire seal is prepared in the free condition, yielding a true and smooth seal surface. When the washer is installed, as in FIG. 4, the force of the preload installation height is imposed at seal lands (27) and (26). This force causes sufficient compressive stress at the line contact between seal lands (27) and (26) and the seal surfaces (29) and (30) to allow the soft conformal coating to flow and effect an efficient seal. No special manufacturing techniques of lapping or honing are required.

The preload force resulting from the preload height of FIG. 4 generates enough force against the seal lands (27) and (26) to oppose normal operating pressures that appear in chambers (19) and (20). Normal operating pressure actually assists sealing when the boat is underway. Pressure in chamber (19) resists propeller thrust loads and is of the order of 500 psi. This pressure acting against the face of washer (24), will subtract from the preload at land (27) and add to the preload at land (26). Since the preload is initially born equally by the opposing forces at lands (26) and (27), the initial seal stresses are unequal as the seal line circumference at land (26) is much larger than the seal line at land (27). Pressures in chamber (19), therefore acting against the face of washer (24), will reduce the seal line stresses at land (27) and increase the seal line stresses at land (26) tending to equalize these stresses. At certain design pressure in chamber (31), determined by the designer, the spring washer (24), experiencing this pressure against face (33), begins to move from its seat at land (26) and deflect, as shown in FIG. 5. This deflection causes a fluid passage (32) to allow flow from chamber (20) to chamber (19) through passages (25) in the piston body (21). The washer continues to deflect as the pressure rises, causing passage (29) to further increase in flow area. When the flow area of passages (32) approaches the flow area of passages (25), the flow restriction is shared by the two passages. As the pressure continues to rise and the flow across piston (5) increases, it will appreciated that the fixed passages (25) may become the controlling restriction and little further deflection of the washer (24) is required. Thus, the maximum deflection of the washer (24) can be controlled by the size of the passages (25), and the passages (25) along with the passage (32) determines the energy absorption capability of this arrangement. When motion of the rod (3) stops, pressure in chamber (20) drops and the washer returns to the preload condition, re-establishing the seals at lands (26) and (27) and returning the piston group (5) to its normal operating condition.

FIGS. 8–11 shows another embodiment of the present invention, an hydraulic trim cylinder assembly (100). It will be appreciated that the cylinder assembly (100) includes several parts similar to those of the cylinder assemblies described above and shown in FIGS. 1–7, and further discussion relating thereto is limited for sake of brevity. The cylinder assembly (100) includes a molded plastic housing (102). The housing (102) has a cylindrical bore portion (104), an end cap portion (106), and a longitudinal passage portion (108). The bore portion (104) and the end cap portion (106) are formed, for example, by molding it as a single plastic part, and this technique reduces manufacturing costs. Thermoset, thermoplastic, or other molding processes may be used. The elimination of a separate end cap part such as end cap (1) also eliminates a potential leakage point. Furthermore, the use of plastic for the housing (102) reduces the potential for corrosion.

The assembly (100) also includes an end cap (110). The end cap (110) attaches to the housing (102) by engagement of threads (114) of the end cap (110) with internally threaded portion (116) of the housing (102). It will be appreciated, however, that the end cap (110) may be secured to the housing (102) by other means, for example by using an adhesive to bond the end cap (110) to the housing (102).

A piston (120), similar in design to the piston (5) described above, is bolted to rod (122). Since the housing (102) is made of plastic, the bore portion (104) may be somewhat tapered due to the manufacturing (molding) process to make that part, and it also is possible that in use the plastic housing may expand more than a metal cylinder may expand when chambers (124) and (126) on opposite sides of the piston (120) are pressurized. Therefore resilient seals (128) and (130) are employed to prevent flow across the piston (120) along inner surface (132) of the bore portion (104). These seals (128) and (130) preferably are adequately compliant as to maintain a suitable sealing relation between the piston (120) and the inner surface (132) of the bore portion (104) even for bores which are tapered and/or under conditions where the housing bore portion wall(s) are somewhat expanded. The exemplary seals illustrated are known as "cup" seals; other suitably compliant seals may also be used.

Figure 8A:
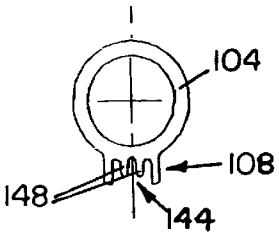
FIG. 8A is an end view of the trim cylinder of FIG. 8 looking in the direction of arrows 8A—8A of FIG. 8.

The housing (102) also includes ports (140) and (142), which are attached to hydraulic pumps and valves (not shown). The port (142) is in communication with the chamber (126) via longitudinal passage (144) (FIG. 8A). The port (140) is in communication with the chamber (124). Since the chamber (124) is at the end of the bore section (104) where the ports are, no longitudinal passage is required to effect the connection of the port (140) and the chamber (124).

Figure 9A:
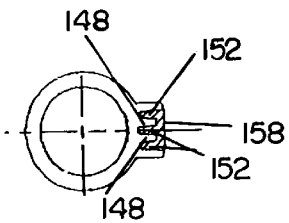
FIG. 9A is an end view of the trim cylinder of FIG. 8 looking in the direction of arrows 9A—9A of FIG. 9.
Figure 8:
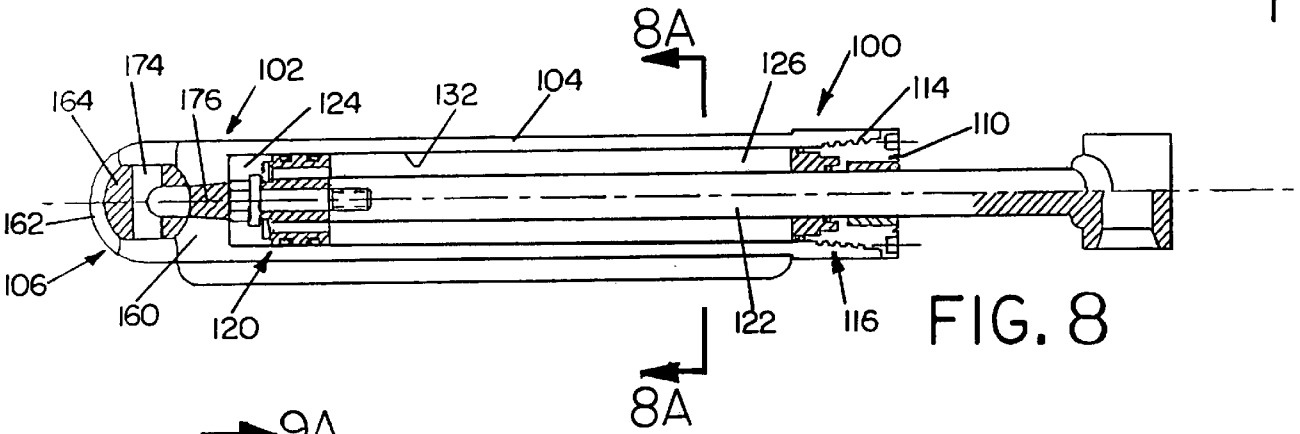
FIG. 8 is a side elevation partly in section showing another embodiment of a trim cylinder of the invention.
Figure 9:
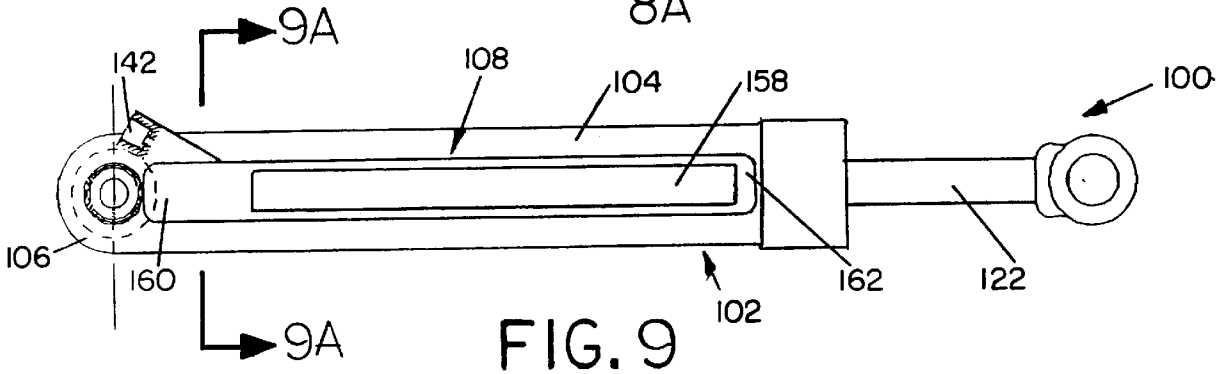
FIG. 9 is a plan view of the trim cylinder of FIG. 8.
Figure 10:
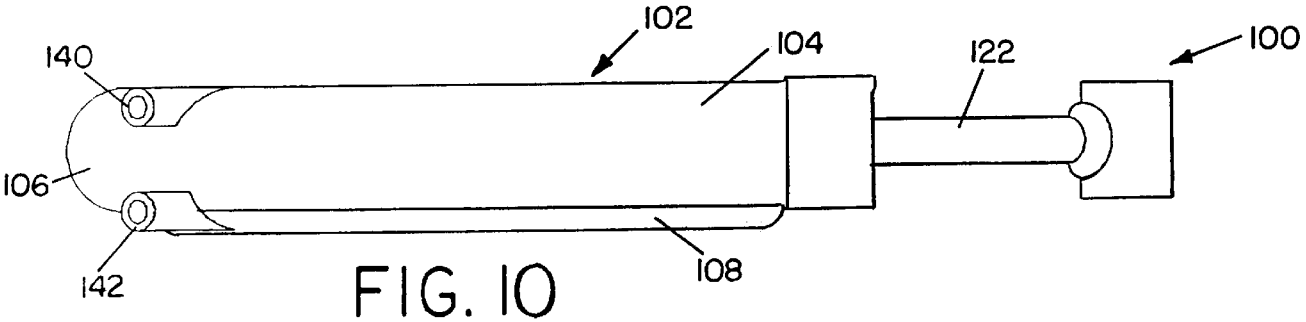
FIG. 10 is a side view of the trim cylinder of FIG. 8.

The passage portion (108) of the housing (102) includes prongs or walls (148) which run the length of the passage portion (108) and protrude into the longitudinal passage (144). The prongs (148) mate with protrusions (152) of cover (158) (FIG. 9A). The protrusions (152), unlike the prongs (148), do not run the length of the passage portion (108), but are present only in end sections (160) and (162) of the cover (158). The purpose of the mating of the prongs (146) and the protrusions (152) is to provide increased surface area for enhanced bonding of the cover (158) to the passage portion (108) of the housing (102). The cover (158), when in place, seals the passage (144) against external leakage of hydraulic fluid. The cover (158) may be secured to the housing (102) by adhesive or other means.

Figure 11:
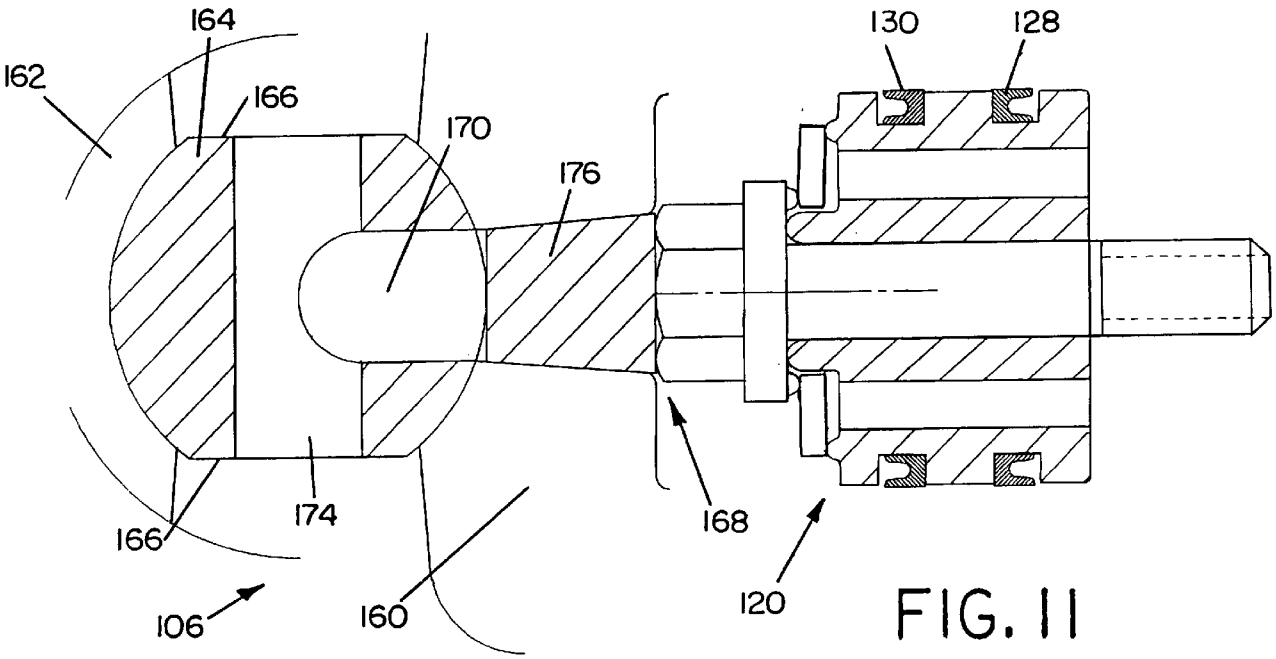
FIG. 11 is an enlarged view of the piston and housing of the trim cylinder of FIG. 8 in the vicinity of the end cap portion of the housing.

Referring to FIG. 11, the end cap portion (106) includes an end wall (160) and a bearing housing (162) with a bearing (164) situated therein. The bearing (164) is generally spherical, with flattened side surfaces (166). The bearing housing (162) is formed around the bearing (164) during the molding process by which the housing (102) is formed.

A hole (168) is provided in the end wall (160), and a corresponding hole (170) is provided in the bearing (164). These holes (168) and (170) are used in the manufacture of the housing (102) as described below.

During manufacture of the housing an insert (not shown) corresponding to the desired shape of the bore of the bore section (104) is placed in the mold. This insert passes through the holes (168) and (170) and is supported by a supporting rod (not shown) which passes through a bore (174) in the bearing (164). After the molding of the housing is completed, the supporting rod and insert are removed and a plug (176) is inserted in the hole (168).

An advantage to the present design is that bearing (164) prevents breakage of the end cap portion (106) in the event of impact described below. In use the end cap portion (106) is secured to a stainless steel mounting rod (not shown). In the event of a large enough impact to the cylinder and/or the mounting rod, the mounting rod may bend, distort, or otherwise yield. This bending of the mounting rod, if enclosed by a close-fitting section of the end cap portion (106), could lead to breakage of a rigid plastic portion adjacent the mounting rod. However, with the bearing (164) molded in the end cap portion (106) of the housing (102), bending of the mounting rod will merely result in rotation of the bearing (164) within the bearing housing (162).

What has been described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. An hydraulic actuator comprising:

a housing having an annular bore; and a piston slidable within the bore, the piston including:

a body with at least one fluid passage therethrough; and a relief valve for selectively allowing fluid flow through the at least one passage, the relief valve including an annular spring surrounding an axis of the body and a preload mechanism for urging the spring against the body.

2. The actuator of claim 1, wherein the annular spring is a Belleville washer.

3. An hydraulic actuator comprising:

a housing including a single plastic molded piece having an annular bore therein and an end portion which is substantially closed; and a piston slidable within the bore, the piston including:

a body with at least one fluid passage therethrough; and a relief valve for selectively allowing fluid flow through the at least one passage.

4. The actuator of claim 3, further comprising an end cap at the end of the annular bore opposite the end portion.

5. The actuator of claim 3, wherein the end portion has a hole therethrough and the actuator further comprises a tapered plug in the hole.

6. The actuator of claim 3, the body having at least one resilient seal in contact with the molded piece along the bore, the at least one seal being able to accommodate variations in diameter of the bore or changes in diameter of the bore due to changes in pressure within the housing.

7. The actuator of claim 3, wherein the end portion has a hole therethrough and the actuator further comprises a tapered plug insertable in the hole.

8. The actuator of claim 3, the body having at least one resilient seal in contact with the molded piece along the annular bore, the at least one seal being able to accommodate variations in diameter of the annular bore, or changes in diameter of the annular bore due to changes in pressure within the housing.

9. The actuator of claim 3, wherein the end portion includes a bearing.

10. The actuator of claim 9, wherein the end portion further includes an end wall, the end wall and the bearing each having a hole for passage of an insert therethrough.

11. An hydraulic actuator comprising:

a housing having an annular bore, the housing including a cylinder and two end caps adhesively adhered to the cylinder; and a piston slidable within the bore, the piston including: a body with at least one fluid passage therethrough; and a relief valve for selectively allowing fluid flow through the at least one passage.

12. The actuator of claim 11, wherein the cylinder is metal and the end caps are plastic.

13. A relief valve mechanism comprising:

a body having at least one fluid passage therethrough;

an annular spring mechanism alternatively in a closed position preventing fluid flow through the body when the spring mechanism is in contact with the body, or in an open position allowing fluid flow through the body when the spring mechanism is not in contact with the body; and a preload mechanism for urging the spring mechanism against the body;

wherein the spring mechanism is in the open position when a pressure difference across the spring mechanism is greater than a given value and the spring mechanism is in the closed position when the pressure difference is less than the given value.

14. An hydraulic actuator comprising:

a housing having an annular bore, the housing including a cylinder and at least two end caps adhered to the cylinder, the end caps having a lower modulus of elasticity and stiffness than the cylinder; and a piston slidable within the bore, the piston including: a body with at least one fluid passage therethrough; and a relief valve for selectively allowing fluid flow through the at least one passage.

15. The actuator of claim 14, wherein the cylinder is metal and the end caps are plastic.

16. A relief valve mechanism comprising:

a body having at least one fluid passage therethrough;

an annular spring mechanism alternatively in a closed position preventing fluid flow through the body when at least a portion of the spring mechanism is in contact with the body, or in an open position allowing fluid flow through the body when the at least a portion is not in contact with the body; and a preload mechanism for urging the spring mechanism against the body.

17. The valve mechanism of claim 16, wherein the spring mechanism includes a Belleville washer and the body has a body land thereon which contacts a first seat of the washer at a first contact line when the spring mechanism is in the closed position.

18. The valve mechanism of claim 17, wherein a maximum distance between the first seat and the body land is a function of the configuration of the at least one fluid passage.

19. The valve mechanism of claim 18, wherein the preload mechanism is a retainer bolt having a bolt land thereon which contacts a second seat of the washer at a second contact line.

20. The valve mechanism of claim 19, wherein the first and second contact lines are circular, the first contact line having a larger radius than the second contact line.

21. The valve mechanism of claim 20, wherein the amount of force urging the spring mechanism against the body may be adjusted by changing the position of the bolt.

22. The valve mechanism of claim 21, wherein the Belleville washer is conformal coated with a soft metal.

23. A method of absorbing shocks in a hydraulic trim cylinder comprises the steps of:

preventing flow around a piston body by use of a perimeter seal around the perimeter of the body; and preventing flow through fluid passages in the body by use of an annular seal surrounding an axis of the body which seals by contact with a first seal land on the body and a second seal land on a preloading member connected to the body.

24. A cylinder for an hydraulic system, comprising an elongate hollow tubular member having at least one end at least partly closed by an end cap, said end cap having a portion including two surfaces, one of said surfaces facing a surface of the tubular member and the other of said surfaces being exposed to fluid pressure in said tubular member to urge said one surface toward said tubular member in response to such fluid pressure tending to maintain engagement therebetween as pressure increases and physical distortion occurs in response thereto.

25. An hydraulic apparatus, comprising an elongate hollow tubular member having at least one end at least partly closed by an end closure, a rod movable in the tubular member and having a part extending beyond the end closure, the end closure having an opening for passing the rod therethrough, the end closure having a portion at the area of said opening for effecting a seal with said rod in response to increasing pressure in the tubular member, said portion including two surfaces, one of said surfaces facing a surface of the rod and the other of said surfaces being exposed to fluid pressure in said tubular member to urge said one surface toward said rod in response to such fluid pressure tending to maintain sealed relation therewith as pressure increases.

26. An hydraulic device, comprising an elongate tubular body of molded material, the tubular body having a hollow interior, an end closure molded to one end of the tubular body, a piston in the tubular body, a closure at the other end of the tubular body, and a piston rod extending beyond one of the ends of the tubular body, at least one channel molded in the outside of the tubular body for conducting fluid in the channel, a closure for the channel to retain fluid therein, and a fluid connection between said at least one channel and the hollow interior for fluid flow therebetween.

27. The device of claim 26, said molded material comprising a plastic material.

28. A fluid actuator, comprising, a body having plural chambers separated by a piston, the piston being movable in the body toward one or the other of the chambers, a rod extending out from the chamber, a closure at one end of the body, the closure having a bearing molded directly therein allowing rotatable connection to an external member to which the actuator is connected.

29. The actuator of claim 28, said body and closure comprising an integrally molded structure.

30. A fluid actuator for marine use to adjust the tilt of an outdrive, comprising:

an elongate tubular housing having a piston slidably movable therein separating the housing into respective chambers on opposite sides of the piston, a piston rod coupled to the piston, the actuator being able to be coupled to an outdrive to adjust the tilt thereof, means for supplying fluid to a respective chamber to urge the piston in a respective direction in the housing to adjust tilt of the outdrive, and the piston including a body with at least one fluid passage therethrough, and a relief valve for passing fluid from one chamber to the other to allow movement of the outdrive when force exceeding a prescribed magnitude is applied to the outdrive tending to tilt the outdrive, the relief valve including an annular spring surrounding an axis of the body and a preload mechanism for urging the spring against the body.

31. The cylinder of claim 24 wherein the end cap is made of plastic.

32. The cylinder of claim 24 wherein the end cap is adhesively joined to the tubular member.

33. The hydraulic apparatus of claim 25 wherein the end closure is made of plastic.

34. The cylinder of claim 33 further comprising an O-ring between the rod and the end cap.

35. The device of claim 26 wherein the closure for the channel has protrusions which mate with end sections of the at least one channel.

36. The device of claim 35 wherein the protrusions and the end sections are adhesively adhered.

37. The device of claim 26 wherein the at least one channel includes two channels with a prong therebetween.

38. The actuator of claim 3, wherein the body includes at least one cup seal in contact with the molded piece along the annular bore.

39. The actuator of claim 9, wherein the at least one resilient seal includes at least one cup seal.

* * * * *